US009856425B2

(12) United States Patent
Ward et al.

(10) Patent No.: US 9,856,425 B2
(45) Date of Patent: Jan. 2, 2018

(54) METHOD OF PRODUCING AROMATICS AND LIGHT OLEFINS FROM A HYDROCARBON FEEDSTOCK

(71) Applicants: SAUDI BASIC INDUSTRIES CORPORATION, Riyadh (SA); SABIC GLOBAL TECHNOLOGIES B.V., Bergen op Zoom (NL)

(72) Inventors: Andrew Mark Ward, Stockton-on-Tees (GB); Thomas Hubertus Maria Housmans, Geleen (NL); Arno Johannes Maria Oprins, Maastricht (NL)

(73) Assignees: Saudi Basic Industries Corporation, Riyadh (SA); Sabic Global Technologies B.V., Bergen Op Zoom (NL)

( * ) Notice: Subject to any disclaimer, the term of this patent is extended or adjusted under 35 U.S.C. 154(b) by 0 days.

(21) Appl. No.: 14/901,857

(22) PCT Filed: Jun. 30, 2014

(86) PCT No.: PCT/EP2014/063854
§ 371 (c)(1),
(2) Date: Dec. 29, 2015

(87) PCT Pub. No.: WO2015/000846
PCT Pub. Date: Jan. 8, 2015

(65) Prior Publication Data

US 2016/0369190 A1 Dec. 22, 2016

(30) Foreign Application Priority Data

Jul. 2, 2013 (EP) ..... 13174775

(51) Int. Cl.
*C07C 4/02* (2006.01)
*C07C 4/04* (2006.01)
(Continued)

(52) U.S. Cl.
CPC ..... *C10G 69/06* (2013.01); *C10G 55/04* (2013.01); *C10G 67/00* (2013.01);
(Continued)

(58) Field of Classification Search
CPC .... C07C 4/02; C07C 4/04; C07C 4/06; C07C 7/10; C10G 47/00
(Continued)

(56) References Cited

U.S. PATENT DOCUMENTS 2,374,102 A * 4/1945 Jahn ..... C10G 47/00 208/61
4,150,061 A 4/1979 Feinstein et al.
(Continued)

FOREIGN PATENT DOCUMENTS

CN 101208412 6/2008
CN 102795958 11/2012
(Continued)

OTHER PUBLICATIONS

Alfke et al. (2007) Oil Refining, Ullmann's Encyclopedia of Industrial Chemistry.
(Continued)

*Primary Examiner* — Thuan D Dang
(74) *Attorney, Agent, or Firm* — Norton Rose Fulbright US LLP

(57) ABSTRACT

The present invention relates to method of producing aromatics and light olefins from a hydrocarbon feedstock comprising the steps of: (a) subjecting the hydrocarbon feedstock to a solvent extraction process in a solvent extraction unit; (b) separating from the solvent extracted hydro-
(Continued)

Figure 1:
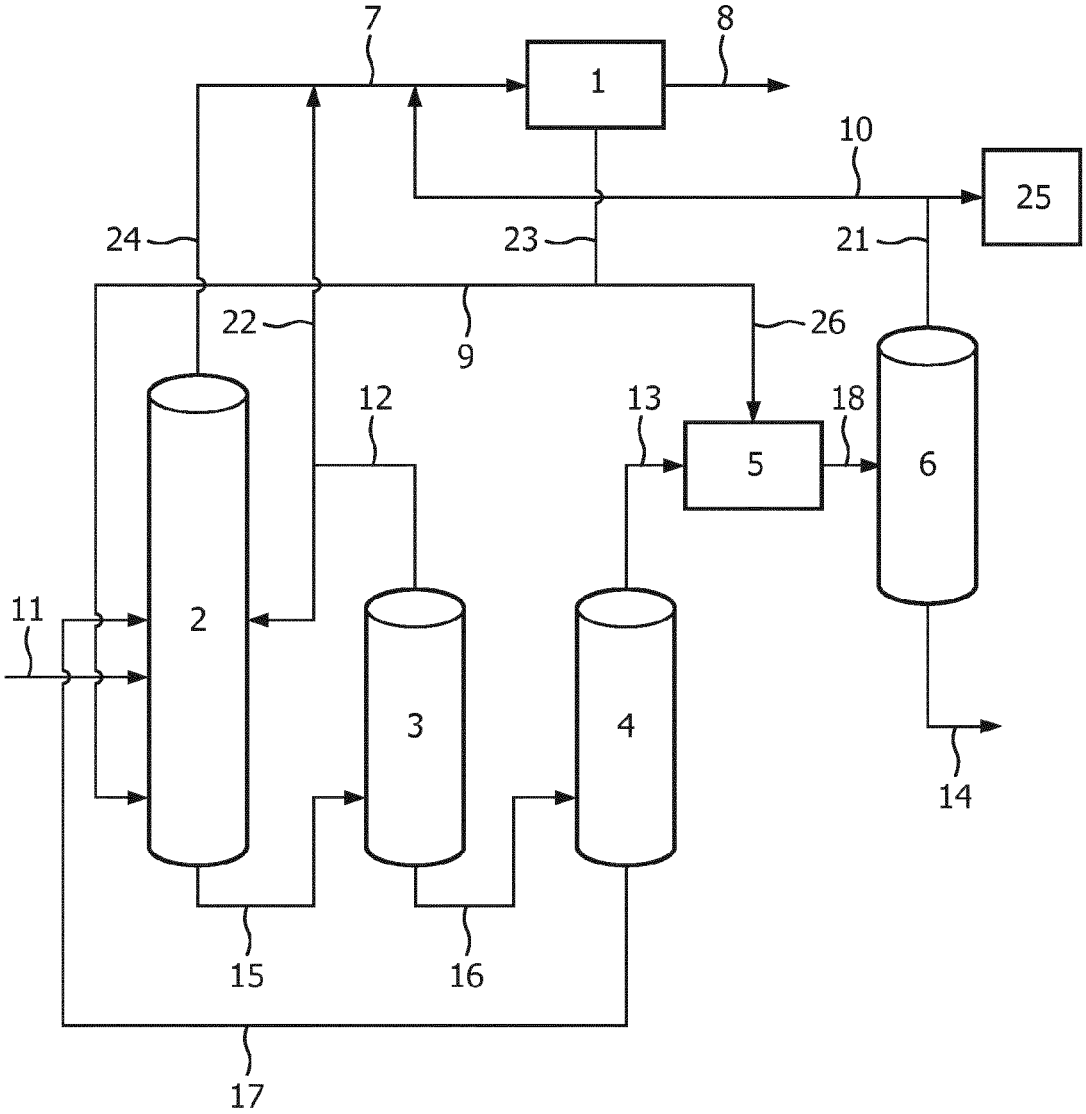

carbon feedstock obtained in step (a) a raffinate fraction comprising paraffins and a fraction comprising aromatics and naphtenes; (c) converting said fraction comprising aromatics and naphtenes in a hydrocracking unit and separating into a high content aromatics fraction and a stream high in light paraffins; (d) converting said raffinate fraction in a steam cracking unit into light olefins.

18 Claims, 1 Drawing Sheet

(51) Int. Cl.

| | |
|---|---|
| ***C07C 4/06*** | (2006.01) |
| ***C07C 7/10*** | (2006.01) |
| ***C10G 69/06*** | (2006.01) |
| ***C10G 55/04*** | (2006.01) |
| ***C10G 67/00*** | (2006.01) |
| ***C10G 67/04*** | (2006.01) |
| ***C10G 69/00*** | (2006.01) |
| ***C10G 69/14*** | (2006.01) |

(52) U.S. Cl.
CPC ..... *C10G 67/0445* (2013.01); *C10G 69/00* (2013.01); *C10G 69/14* (2013.01); *C10G 2400/20* (2013.01); *C10G 2400/30* (2013.01)

(58) Field of Classification Search
USPC ..... 585/319, 648, 752, 833, 856, 860; 208/108, 130
See application file for complete search history.

(56) References Cited

U.S. PATENT DOCUMENTS

| | | | | |
|---|---|---|---|---|
| 4,341,622 | A | 7/1982 | Tabuk et al. | |
| 4,827,072 | A | 5/1989 | Imai et al. | |
| 4,926,005 | A | 5/1990 | Olbrich et al. | |
| 5,609,750 | A * | 3/1997 | Nat | B01J 21/02 208/122 |
| 5,880,325 | A | 3/1999 | Alward et al. | |
| 5,883,034 | A | 3/1999 | Drake et al. | |
| 7,622,623 | B2 | 11/2009 | Fridman et al. | |
| 2007/0090018 | A1 | 4/2007 | Keusenkothen et al. | 208/106 |
| 2007/0227948 | A1 * | 10/2007 | Ramirez-Corredores | C10G 25/003 208/208 R |
| 2008/0194900 | A1 | 8/2008 | Bhirud | |
| 2010/0300932 | A1 | 12/2010 | Debuisschert et al. | |

FOREIGN PATENT DOCUMENTS

| | | | |
|---|---|---|---|
| CN | 102803184 | | 11/2012 |
| CN | 104031680 | | 9/2014 |
| EP | 0192059 | A1 | 8/1986 |
| GB | 1248814 | | 10/1971 |
| GB | 2162082 | A | 1/1986 |
| WO | 0244306 | A1 | 6/2002 |
| WO | 2006122275 | A2 | 11/2006 |
| WO | 2007055488 | A1 | 5/2007 |
| WO | 2008092232 | A1 | 8/2008 |
| WO | 2011005476 | A2 | 1/2011 |
| WO | 2012135111 | A2 | 10/2012 |

OTHER PUBLICATIONS

Folkins (2000) Benzene, Ullmann's Encyclopedia of Industrial Chemistry.

International Search Report for International Application No. PCT/EP2014/063854; International Filing Date: Jun. 30, 2014; dated Sep. 22, 2014; 5 Pages.

Written Opinion of the International Searching Authority for International Application No. PCT/EP2014/063854; International Filing Date: Jun. 30, 2014; dated Sep. 22, 2014; 7 Pages.

* cited by examiner

METHOD OF PRODUCING AROMATICS AND LIGHT OLEFINS FROM A HYDROCARBON FEEDSTOCK

The present invention relates to a method of producing aromatics and light olefins from a hydrocarbon feedstock.

CROSS REFERENCE TO RELATED APPLICATIONS

This application is a 371 of International Application No. PCT/EP2014/063854, filed Jun. 30, 2014, which claims priority to European Application No. 13174775.0, filed Jul. 2, 2013 which are incorporated herein by reference in their entirety.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Naphtha, a mixture of hydrocarbons comprising of normal paraffins, isoparaffins, naphthenes and aromatic compounds with boiling points between about 20° C. and about 200° C., can be processed by steam cracking to produce light olefins, aromatic species (especially Benzene, Toluene, Xylenes and ethyl benzene termed C8− Aromatics) and other valuable chemicals. This technology also generates a number of lower value by-products including substituted aromatics species with 9 or more carbon atoms (C9+ Aromatics) and species containing more than one aromatic ring type structure, often with two or more aromatic rings sharing carbon atoms (condensed aromatics). These latter species are thought to be formed from aromatic species, either present in the naphtha feed or formed from naphthenes in the feed naphtha.

The C8− Aromatics are produced in a mixture which also contains paraffinic, olefinic dienic and styrenic species with similar boiling points and sulphur containing organic species such as thiophenes. This material is called Pyrolysis Gasoline, also Pygas for short. When it is desired to produce pure aromatic compounds from Pygas it can be processed via two stages of hydrotreating (1st stage to saturate very reactive diene and styrene molecules along with some olefinic molecules and the second stage to complete the saturation of olefins and hydro-desulphurized the organo-sulphur species) and then via solvent extraction to produce a pure aromatic extract and a raffinate stream containing the non-aromatic species.

An aspect with conventional steam cracking of liquid hydrocarbon streams is the production of low value by-product C9+ aromatics and condensed aromatics and the need for two stages of hydrotreating and solvent extraction processing of the Pygas byproduct.

An aspect of simply hydrocracking naphtha to generate pure aromatics without the need for solvent extraction is that it requires very large quantities of hydrogen. This is because naphtha typically has a significantly larger fraction of paraffinic species (which must be hydrocracked into lower boiling point molecules to facilitate separation via simple fractional distillation) than aromatic species. The hydrogen requirement is proportional to the quantity of paraffinic species present in the feed and so with largely paraffinic streams such as naphtha's very large quantities of hydrogen are required. Furthermore the heat generated by hydrocracking reactions must be managed. For very paraffinic feed streams, such as typical naphtha's, this may require a complex arrangement of reactors and heat exchangers which will increase capital costs.

A consequence of using solvent extraction technologies to produce pure aromatic species from typical naphtha's is that solvents selective for the extraction of aromatics are also somewhat selective for dissolving light non-aromatics and naphthenic species hence the solvent stream exiting the base of the solvent extraction column contains high levels of these non-aromatics species. This means that significant energy is expended in evaporatively stripping these species from the solvent in the first distillation section of the solvent extraction unit (sometimes called the stripper column) to ensure that the aromatic stream generated in the final distillation column (sometimes called the extract column), where the dissolved species are separated from the solvent by distillation, is essentially free from non-aromatic species. The naphthenic species which were present in the feed to the extractor are stripped out of the solvent and fed back to the extractor column in such a way that they ultimately leave the extractor in the non-aromatic raffinate stream and are thus present in the de-aromatized stream which would be fed to the steam cracker where they are partly converted to aromatic species some fraction of which are further reacted to generate low value by-products such as C9+ aromatics and condensed aromatic species.

Furthermore, solvents which are selective for dissolving aromatics compounds are also selective for adsorbing certain organo-sulphur species such as thiophenes. Consequently, it might be difficult to produce an aromatic extract material which is free from contamination with organo-sulphur compounds by using conventional solvent extraction technologies on feeds such as typical naphtha's which contain significant levels of organo-sulphur species. Consequently, the feed to such a unit would require hydrodesulphurization prior to processing to remove organo-sulphur species prior to the solvent extraction step. This would add significant cost and complexity to the process.

An effect of processing naphtha via a molecular sieve technology to generate a normal paraffin stream for steam cracking and a second mixed stream includes a fact that olefins are only produced from the normal paraffinic species in the naphtha (typically −30% of the naphtha) and consequently the olefins yield per unit of feed is much lower than for conventional stream cracking. This means that several additional processing steps (hydrodesulphurization, catalytic reforming and solvent extraction) are required to allow pure aromatics to be produced from the mixed hydrocarbon stream that is not sent to the steam cracker. Moreover, much of the iso-paraffinic material present in the naphtha is unconverted further lowering the yield of useful chemicals from this process.

Light crude oil cuts such a naphtha's and some gas oils can be used for producing light olefins and single ring aromatic compounds via processes such as steam cracking in which the hydrocarbon feed stream is evaporated and diluted with steam then exposed to a very high temperature (800° C. to 860° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value coproducts such as methane and C9+ Aromatics and condensed aromatic species.

Typically, the heavier (or higher boiling point) aromatic species, such as residua are further processed in a crude oil refinery to maximize the yields of lighter (distillable) products from the crude oil. This processing can be carried out by processes such as hydro-cracking (whereby the hydrocracker feed is exposed to a suitable catalyst under conditions which result in some fraction of the feed molecules being broken into shorter hydrocarbon molecules with the simultaneous addition of hydrogen). Heavy refinery stream hydrocracking is typically carried out at high pressures and temperatures and thus has a high capital cost.

An aspect of the conventional hydrocracking of heavy refinery streams such as residua is that these are typically carried out under compromise conditions are chosen to achieve the desired overall conversion. As the feed streams contain a mixture of species with a range of easiness of cracking this result in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process and also increases the yield of light molecules such as methane at the expense of more valuable species.

WO2006/122275 relates to a process for upgrading a heavy hydrocarbon crude oil feedstock into an oil that is less dense or lighter and contains lower sulfur than the original heavy hydrocarbon crude oil feedstock while making value added materials such as olefins and aromatics, which process comprises, inter alia, the steps of: combining a portion of the heavy hydrocarbon crude oil with an oil soluble catalyst to form a reactant mixture, reacting the pretreated feedstock under relatively low hydrogen pressure to form a product stream, wherein a first portion of the product stream includes a light oil having and a second portion of the product stream includes a heavy crude oil residue, and a third portion of the product stream includes a light hydrocarbon gas, and injecting a portion of the light hydrocarbon gas stream in a cracking unit to produce streams containing hydrogen and at least one olefin.

WO2011/005476 relates to a process for the treatment of heavy oils, including crude oils, vacuum residue, tar sands, bitumen and vacuum gas oils using a catalytic hydrotreating pretreatment process, specifically the use of hydrodemetallization (HDM) and hydrodesulphurization (HDS) catalysts in series in order to improve the efficiency of a subsequent coker refinery.

US2008/194900 relates to an olefins process for steam cracking an aromatics—containing naphtha stream comprising: recovering olefins and pyrolysis gasoline streams from a steam cracking furnace effluent, hydrogenating the pyrolysis gasoline stream and recovering a C6-C8 stream therefrom hydrotreating an aromatics-containing naphtha stream to obtain a naphtha feed, dearomatizing the C6-C8 stream with the naphtha feed stream in a common aromatics extraction unit to obtain a raffinate stream; and feeding the raffinate stream to the steam cracking furnace.

WO2008/092232 relates to a process for extraction of chemical components from a feedstock, such as a petroleum, natural gas condensate, or petrochemical feedstock, a whole range naphtha feedstock comprising the steps of: subjecting the whole range naphtha feedstock to a desulphurizing process, separating from the desulphurized whole range naphtha feedstock a C6 to C11 hydrocarbon fraction, recovering from the C6 to 11 hydrocarbon fraction an aromatics fraction, an aromatics precursors fraction and a raffinate fraction in an aromatics extraction unit, converting aromatics precursors in the aromatics precursors fraction to aromatics, and recovering aromatics from step in the aromatics extraction unit.

US2010300932 relates to a process for the production of a hydrocarbon fraction with a high octane number and a low sulfur content from a hydrocarbon feedstock, comprising at least the following stages: a hydrodesulfurization stage of the hydrocarbon feedstock, at least one stage for extracting aromatic compounds over all or part of the effluent that is obtained from the hydrodesulfurization stage, whereby said extraction leads to a paraffin-enriched raffinate relative to the feedstock and an aromatic compound-enriched extract that is sent to a gasoline pool, wherein a portion of the paraffinic raffinate is sent to a steam-cracking unit to produce light olefins there or to a catalytic reforming unit to produce aromatic compounds there.

GB 1248814 relates to a process for cracking hydrocarbons with high selectivity to ethylene or propylene in a tubular reaction zone comprising: (a) treating a petroleum distillate boiling in the gas oil range to selectively separate aromatic compounds from said distillate, (b) mixing said treated feed raffinate hydrocarbons with dilution steam (c) feeding said mixture to a tubular reaction zone; (d) heating said mixture to crack the treated feed with high selectivity to ethylene or propylene and rapidly cooling the effluent from said reaction zone and separating and recovering the ethylene or propylene. U.S. Pat. No. 4,150,061 relates to a process for producing ethylbenzene-lean xylenes and benzene wherein a fractionated pyrolysis gasoline aromatics stream, comprising toluene, C7-C9 paraffins, olefins, naphthenes, ethylbenzene and xylenes is mixed with hydrogen, and subjected to a hydrodealkylation/transalkylation reaction under conditions including a temperature within the range of from 600° to about 1000° F., a pressure in the range of from about 100 to 1000 psig, a hydrogen to hydrocarbon mole ratio of from about 1:1 to 50:1, a contact time within the range of between 1 to 20 seconds and a catalyst.

U.S. Pat. No. 4,341,622 relates to a process for the manufacture of aromatic hydrocarbons which comprises subjecting a hydrocarbon naphtha to catalytic reforming under conditions to convert naphthenes to aromatic hydrocarbons in a reformate reaction product, distilling said reformate to separate compounds of less than nine carbons from a heavy reformate, contacting said heavy reformate with a zeolite catalyst whereby to convert ethylbenzene and alkylbenzenes of more than eight carbon atoms to benzene, toluene and xylene, distilling the product of said contacting to separate benzene, toluene and xylene.

An object of the present invention is to provide a method for upgrading naphtha to aromatics and steam cracker feedstock.

An object of the present invention is to provide a method for upgrading naphtha to aromatics and dehydrogenation unit feedstock.

Another object of the present invention is to maximize the yield of high value products from typical naphtha and other liquid hydrocarbon cracker feeds by preventing naphthenes and aromatics generating heavier products.

Another object of the present invention is to maximize the yield of high value products from typical naphtha and other liquid hydrocarbon cracker feeds, by preventing naphthenes generating methane.

The present invention relates to a method of recovering aromatics and light olefins from a hydrocarbon feedstock comprising the steps of:

(a) subjecting the hydrocarbon feedstock to a solvent extraction process in a solvent extraction unit;

(b) separating from the solvent extracted hydrocarbon feedstock obtained in step (a) a raffinate fraction comprising paraffins and a fraction comprising aromatics and naphthenes;

(c) converting said fraction comprising aromatics and naphthenes in a hydrocracking unit and separating into a high content aromatics fraction and a stream high in light paraffins;

(d) converting said raffinate fraction in a steam cracking unit into light olefins.

On basis of such a process one or more of the presents objects are achieved.

According to such a method, i.e. a combination of a solvent extraction unit (comprising three main hydrocarbon processing columns: Solvent extraction column, stripper column and extract column) together with an "extract hydrocracking/HDS unit" together with a steam cracker the yield of high value products from typical naphtha and other liquid hydrocarbon cracker feeds can be maximized. In the present method a solvent extraction process is used to separate naphtha into two streams one containing only (or nearly only) paraffins (both iso and normal) and another containing both aromatic and naphthenic molecules. By operating the stripper column and solvent extraction column in a proper way loss of naphthenes into the raffinate can be avoided significantly.

According to the present invention both the aromatic and naphthenic compounds are extracted and then processed through a hydrocracker unit. Such a hydrocracker unit is preferably capable of converting the sulphur compounds to $H_2S$ and converts a substantial portion of the naphthenes into aromatics and hydro-cracks (to LPG) the remaining naphthenes together with any paraffins present in the extract. This means that according to the present method there is no need for hydrodesulphurization (HDS) ahead of the extraction process. According to the present method sulphur compounds are allowed to enter the extractor and be extracted (partly or entirely) with the aromatic and naphthenic fraction as the present hydrocracking unit is capable of converting sulphur species into $H_2S$ for simple removal. The present method thus refers to the co-extraction of the naphthenes with the aromatics and the conversion of these to aromatics in the hydrocracking unit, i.e. designing and operating a hydrocracking unit to convert these into aromatics. On basis of the wording of process steps (b) and (c) it is clear that the extract contains the naphthenes, preferably more than half of the naphthenes are in the extract.

The raffinate fraction originating from the solvent extraction process is substantially free of aromatics and significantly lower in naphthenes than the hydrocarbon feedstock of that solvent extraction process.

In the present method the paraffinic stream is fed to a typical steam cracker where it generates high yields of light olefins and other valuable chemicals. The pygas by-product (much lower yield than with un-separated naphtha) is preferably sent to the solvent extraction unit to remove the aromatics and naphthenes produced in the steam cracker unit. The extract stream from the solvent extraction unit is processed via a selective hydrocracker/HDS unit to produce pure aromatic products and a (small) LPG stream which can be fed to the cracking furnaces to generate olefins.

As a result of the present method the present inventors found as aromatics and naphthenic species are removed from the feed prior to steam cracking the downgrading of these materials to C9+ and condensed aromatics species are largely prevented.

According to the present method high hydrogen consumption and the downgrade to LPG species of (higher cracking value) non-aromatic hydrocarbons present in pygas and naphtha feed can be prevented by feeding the pygas into a suitable place in the solvent extraction column to allow aromatic and naphthenic species in the pygas and naphtha feed to be extracted whist allowing the majority of the paraffinic species present to be separated and to leave the extraction column in the raffinate stream that can be fed to the steam cracker. In this way the quantity of paraffinic species in the pygas and naphtha feed which are hydrocracked (thus consuming hydrogen and being downgraded into LPG) is greatly reduced.

Furthermore, according to the present invention the quantity of paraffinic species which must be hydrocracked to be able to achieve the desired aromatic purity is greatly reduced. This is achieved by feeding the naphtha to the solvent extraction column in a suitable place to allow the aromatic and naphthenic species to be dissolved into the solvent whilst allowing the majority of the paraffinic species present in the naphtha to be separated and to leave the extraction column in the raffinate stream that can be fed to the steam cracker. This greatly reduces the quantity of these species which must be hydrocracked thus minimizing hydrogen consumption, the losses due to any downgrade of cracking value and the size and complexity of the subsequent hydrocracking unit.

In the present method the liquid hydrocarbon feed, such as naphtha, is in the solvent extraction step first contacted with an immiscible solvent selective for aromatics separation in a suitable solvent extraction column. The boiling temperature of the immiscible solvents selective for aromatics separation must be higher than the boiling temperature of the components to be separated, i.e. extract containing aromatics and naphthenes. A preferred temperature difference between immiscible solvent and the extract is in the range of 10 to 20° C. In addition, the immiscible solvent may not decompose at the applied temperatures, i.e. the immiscible solvent must be temperature stabile at the specific process temperature. Examples of solvents are sulfolane, tetra ethylene glycol or N-Methyl pyrolidone. These species are often used in combination with other solvents or other chemicals (sometimes called co-solvents) such as water and/or alcohols. To minimize the risk of damaging the hydrocracking catalyst in the present process, it is preferred to use a non-nitrogen containing solvent such as sulfolane. As the solvent (even when it contains significant quantities of dissolved hydrocarbons) has a higher density than the hydrocarbon species it tends to separate to the base of the extraction column and is withdrawn from there. This "rich solvent" (i.e. solvent containing dissolved hydrocarbons) contains aromatic species which were present in the feed liquid as well as other species which are somewhat soluble in the solvent such as light paraffins, naphthenic species as well as some of the organo-sulphur species present in the feed. With conventional technologies the presence of the non-aromatic hydrocarbon species causes a difficulty which requires these species to be stripped from the "rich solvent" in a distillation column (together with some of the lower boiling point aromatic compounds) and returned to the solvent extraction column. To ensure that the aromatic product stream is essentially free from non-aromatics contaminants it is necessary to expend significant quantities of energy in stripping out even minor traces of these species from the solvent.

In the present process the ratio of the hourly circulation rate for the solvent to hour fresh feed rate (sum of naphtha and any Pygas) may be in the range of 1:1 to 10:1 (on a mass:mass basis). The preferred solvent: feed ratio is in the region of 2:1 to 5:1.

Both the solvent and the feed(s) may be heated (e.g. via the use of heat exchanges or steam heaters) to between 20° C. and approximately 90° C. with the preferred degree of preheat selected to the optimal balance between solvent capacity (which increases with solvent temperature) and selectivity (which decreases with solvent temperature) and to avoid the generation of a significant vapor pressure in the raffinate stream. The preferred temperature for the feed and solvent (and thus the prevailing temperature in the solvent extraction column) is in the range 30 to 60° C.

In the process according to the invention there is less need to remove all the non-aromatic species from the solvent in the stripper column and the extract stream will be fed to a hydrocracking unit which is efficient for converting paraffinic species into LPG molecules which do not co-boil with benzene. In a preferred embodiment the naphthenic species are also retained in the solvent exit the stripper column as these species are converted into aromatic species in the subsequent hydrocracking reactor.

The present inventors found that in the process according to the invention it is not necessary to generate sales grade aromatics extract directly from the solvent extraction unit as the aromatic extract from the solvent extraction unit will be further processed in a selective hydrocracking and hydrodesulphurization unit. This, latter, unit is suitable for preserving the aromatic species in the feed whilst simultaneously dehydrogenating a portion of the naphthenic species into aromatic species, hydrocracking non-aromatic species (including remaining naphthenic species and paraffinic species) into LPG species (which can be easily separated from the aromatics species by simple distillation) and hydrodesulphurising any organo-sulphur species present in the stream. Thus, it is not necessary or even desirable to strip out the naphthenic species from the "rich solvent" as (at least a portion of) these will later be converted to aromatic compounds in the subsequent processing unit. Furthermore, it is not necessary to remove low levels of paraffinic species from the "rich solvent" as these will later be hydrocracked to produce light paraffins which can be separated from the aromatics by simple distillation and if desired sent to the cracker as feed stream. Hence, the degree of light non-aromatic hydrocarbon stripping becomes an economic optimization around the value of the energy required for stripping of the rich solvent and the value of the hydrogen consumed in the later hydrocracking step together with the difference in the cracking value of the LPG species produced in the subsequent hydrocracking unit compared with the cracking value of the light non-aromatic species that would be included in the raffinate stream if they were stripped out of the solvent. By reducing the degree of stripping of the "rich solvent" this invention saves considerable energy compared with the conventional solvent extraction process and may also reduce the capital cost of the solvent extraction unit (as the stripping column and associated equipment can be reduced in size) whilst increasing the overall yield of aromatics from the naphtha stream (as naphthenic species are converted more efficiently to useful aromatics in the hydrocracking unit than they would be in a steam cracker. Additionally, as the selective hydrocracking unit carries out hydro-desulphurization it is not necessary to desulphurize the feed prior to solvent extraction.

One basis of the present method the majority of the paraffinic species (both normal and iso-) will be present in the raffinate stream that is fed to the steam cracker thus greatly increasing percentage yield of light olefinic and other valuable products that can be produced from the feed naphtha. Furthermore, the steps needed to produce high purity aromatics products from the extract stream (containing aromatics, naphthenic species and low levels of other light hydrocarbons and organo-sulphur) are greatly reduced as a single process preserves aromatic species, converts naphthenic species into additional aromatics, hydro-cracks non-aromatic hydrocarbons and hydrodesulphurizes organo-sulphur species such that pure aromatics can be produces by simple distillation.

As discussed above, in the present method the fraction exiting the base of the extractor column and comprising aromatics and naphthenes together with some light paraffinic species dissolved in the solvent is further fractionated by a stripping process to increase its aromatics and naphthenes content, in which said stripping process is based on differences in relative volatility. The rich solvent stream, exiting the base of the solvent extractor is then processed in the stripper column to reduce the quantity of paraffinic species dissolved in the solvent and would thus be present in the extract stream fed to the hydrocracker. This second column works to separate species on the basis of their relative volatility in the presence of the solvent rather than simple boiling point.

In a preferred embodiment the fraction comprising aromatics and naphthenes is further fractionated by recovering the solvent from the solvent extraction process and returning said recovered solvent to said solvent extraction process of step (a), in which said fractionation is based on differences in relative volatility.

In the final column of the separation section of the method according to the present invention the aromatics, together with the (desired) naphthenes and any (undesired) paraffinic hydrocarbons, dissolved in the solvent will be removed from the solvent by distillation. The base temperature in the solvent recovery column is set to minimize solvent evaporation whilst ensuring that essentially all the dissolved hydrocarbon species are evaporated. Consequently the preferred base temperature differs depending on the specific solvent used. This distillation may be carried out at sub atmospheric pressure to minimize the temperature required for essentially complete evaporation of the extract and thus to reduce any thermally induced deterioration to the solvent.

According to a preferred embodiment of the present invention most of the paraffins in the hydrocarbon feedstock are separated and sent to the steam cracking unit but a portion of these paraffins, for example 10%, are still present in the extract that is fed to hydrocracking unit. Furthermore, some of these paraffins are difficult to separate from aromatic species by simple distillation. The purpose of the hydrocracking unit, therefore, is to hydrocrack these paraffins to smaller species (LPG) which are easy to separate from BTX aromatics via simple distillation, e.g. in a separation unit producing a C5-stream and a BTX stream and which are suitable feeds for a steam cracking unit. In addition to this the hydrocracking unit is operated in such a way as to convert at least a portion of the naphthenic species in its feed into BTX aromatics, wherein the remainder being hydrocracked into LPG species.

The present method further comprises recovering a pygas containing byproduct from the steam cracking unit and returning said recovered pygas containing byproduct to said solvent extraction column.

As discussed above, the recovered solvent is fed to the solvent extraction column at a position above the inlet points of both the recovered pygas containing byproduct and the hydrocarbon feedstock in said solvent extraction unit.

The present method further comprises feeding said hydrocarbon feedstock to the solvent extraction column at a position above the inlet point of the recovered pygas containing byproduct in said solvent extraction unit.

According to a preferred embodiment the method further comprises recovering a LPG fraction from said hydrocracked high content aromatics fraction and returning said LPG fraction to the steam cracking unit, wherein said recovering is preferably carried out by a distillation unit.

According to a preferred embodiment of the present invention the feed stream to the inlet of the steam cracking unit comprises the combined raffinate from the solvent extraction process. Such a feed stream thus comprises the majority of the paraffins in the hydrocarbon feedstock plus a significantly lower quantity of the naphthenes than were present in that hydrocarbon feedstock and only a very small fraction of the aromatic species present in that hydrocarbon feedstock as well.

According to a preferred embodiment of the present invention the extract from the solvent extraction process is fed to a hydrocracking unit. Such an extract thus comprises substantially all the aromatics species present in the hydrocarbon feedstock plus a large proportion of the naphthenes that were present in that hydrocarbon feedstock plus a significantly lower quantity of paraffins than were present in that hydrocarbon feedstock.

According to a preferred embodiment of the present invention the light products from the hydrocracking unit comprises predominantly ethane, propane and butane and essentially free of species containing six or more carbon atoms.

From a solvent efficiency point of view it is preferred to recover the solvent from the raffinate fraction comprising paraffins and to return said solvent recovered into the solvent extraction process.

As discussed above, the LPG fraction can be fed to a hydrogenation unit, especially the C3-C4 fraction thereof.

Examples of suitable hydrocarbon feedstock to be processed in the present method are chosen from the group of whole range naphtha, hydrocarbon distillates having a boiling point lower than 200° C. and kerosene.

Whilst feeds with initial boiling points as low as 20° C. are suitable for the present method, a preferred feedstock would be a hydrocarbon mixture with a boiling point only a little below the boiling points of the lowest boiling desired extract products—benzene and cyclo-hexane. The present inventors assume that this is because paraffins with low boiling points are reasonably soluble in aromatic selective solvents and would thus be extracted and require separating from the solvent in the stripper column. If the stripper overhead stream is routed directly to the steam cracker there is no real advantage to predistilling a feed to remove these lights prior to the extraction column but if the stripper overhead is routed back to the extraction column (to minimize aromatic losses) then a (large) portion of the light paraffin species which have been separated in the stripper column will tend to re-dissolve in the solvent and thus cycle round between the extraction column and the stripper and consume significant energy.

The process conditions and catalysts in the hydrocracking unit are such that preferably also hydro-desulphurization reactions are carried out. The extract from the extraction column is fed to the hydrocracking/hydrodesulphurization unit where nonaromatics species are either hydrocracked (in the case of paraffinic species) or converted to aromatic species (predominantly in the case of naphthenic species). In this unit sulphur containing species are converted to H2S and light hydrocarbons effectively desulphurising the extract. As nitrogen containing compounds would yield ammonia in this unit and ammonia would be expected to act as poison for the catalyst used in this process it is preferred that a non-nitrogen containing solvent (such as sulfolane, as mentioned before) is used in the extraction step or that the extract is processes via an acid clay bed (which absorbs nitrogen containing species) prior to processing in the hydrocracking process section.

The preferred operating conditions for the hydrocracking/HDS process step are WHSV between 0.5 and 3 H-1, a H2:hydrocarbon ratio between 2:1 and 4:1, pressure between 100 and 400 psig and reactor inlet temperature between 470 and 550° C. Suitable catalysts for this hydrocracking/hydrodesulphurization processing step include catalysts comprising precious metals such as Pt and Pd supported on support materials such as Alumina and acid form zeolites such as HZSM-5. These operating conditions are preferably based on those which have given favorable results with un-extracted pygas.

The separation of aromatics and non-aromatic species in the extraction column is based on the different relative solubility's of these classes of molecules in the chosen solvent.

The term "crude oil" as used herein refers to the petroleum extracted from geologic formations in its unrefined form. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands and bio-based oils. The crude oil is preferably conventional petroleum having an API gravity of more than 20° API as measured by the ASTM D287 standard. More preferably, the crude oil used is a light crude oil having an API gravity of more than 30° API. Most preferably, the crude oil comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekule structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly relates types of alkanes that have one or more rings of carbon atoms in the chemical structure of their molecules.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

The term "BTX" as used herein relates to a mixture of benzene, toluene and xylenes.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

As used herein, the term "hydrocracker unit" or "hydrocracker" relates to a refinery unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-20 MPa, space velocities between 0.1-10 h-1

Hydrocracking reactions proceed through a bifunctional mechanism which requires an acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by composting various transition metals, or metal sulfides with the solid support such as alumina, silica, alumina-silica, magnesia and zeolites.

As used herein, the term hydrocracker may refer to a "gasoline hydrocracking unit" or "GHC" refers to a refinery unit for performing a hydrocracking process suitable for converting a complex hydrocarbon feed that is relatively rich in aromatic hydrocarbon compounds—such as refinery unit-derived light-distillate including, but not limited to, reformer gasoline, FCC gasoline and pyrolysis gasoline (pygas)- to LPG and BTX, wherein said process is optimized to keep one aromatic ring intact of the aromatics comprised in the GHC feedstream, but to remove most of the side-chains from said aromatic ring. Accordingly, the main product produced by gasoline hydrocracking is BTX and the process can be optimized to provide chemicals-grade BTX. Preferably, the hydrocarbon feed that is subject to gasoline hydrocracking comprises refinery unit-derived light-distillate. More preferably, the hydrocarbon feed that is subjected to gasoline hydrocracking preferably does not comprise more than 1 wt-% of hydrocarbons having more than one aromatic ring. Preferably, the gasoline hydrocracking conditions include a temperature of 300-580° C., more preferably of 450-580° C. and even more preferably of 470-550° C. Lower temperatures must be avoided since hydrogenation of the aromatic ring becomes favorable. However, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

Preferably, the gasoline hydrocracking of a hydrocarbon feedstream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ nonaromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene ata pressure of 1.2-1.6 MPa.

Preferably, gasoline hydrocracking of a hydrocarbon feedstream is performed at a Weight Hourly Space Velocity (WHSV) of 0.1-10 h-1, more preferably at a Weight Hourly Space Velocity of 0.2-6 h-1 and most preferably at a Weight Hourly Space Velocity of 0.4-2 h-1. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Accordingly, preferred gasoline hydrocracking conditions thus include a temperature of 450-580° C., a pressure of 0.3-5 MPa gauge and a Weight Hourly Space Velocity of 0.1-10 h-1. More preferred gasoline hydrocracking conditions include a temperature of 470-550° C., a pressure of 0.6-3 MPa gauge and a Weight Hourly Space Velocity of 0.2-6 h-1. Particularly preferred gasoline hydrocracking conditions include a temperature of 470-550° C., a pressure of 1-2 MPa gauge and a Weight Hourly Space Velocity of 0.4-2 h-1.

As used herein, the term hydrocracker may also refer to a "feed hydrocracking unit" or "FHC" refers to a refinery unit for performing a hydrocracking process suitable for converting a complex hydrocarbon feed that is relatively rich in naphthenic and paraffinic hydrocarbon compounds—such as straight run cuts including, but not limited to, naphtha—to LPG and alkanes. Preferably, the hydrocarbon feed that is subject to feed hydrocracking comprises naphtha. Accordingly, the main product produced by feed hydrocracking is LPG that is to be converted into olefins (i.e. to be used as a feed for the conversion of alkanes to olefins). The FHC process may be optimized to keep one aromatic ring intact of the aromatics comprised in the FHC feedstream, but to remove most of the side-chains from said aromatic ring. In such a case, the process conditions to be employed for FHC are comparable to the process conditions to be used in the GHC process as described herein above. Alternatively, the FHC process can be optimized to open the aromatic ring of the aromatic hydrocarbons comprised in the FHC feedstream. This can be achieved by modifying the GHC process as described herein by increasing the hydrogenation activity of the catalyst, optionally in combination with selecting a lower process temperature, optionally in combination with a reduced space velocity. In such a case, preferred feed hydrocracking conditions thus include a temperature of 300-550° C., a pressure of 300-5000 kPa gauge and a Weight Hourly Space Velocity of 0.1-10 h-1. More preferred feed hydrocracking conditions include a temperature of 300-450° C., a pressure of 300-5000 kPa gauge and a Weight Hourly Space Velocity of 0.1-10 h-1. Even more preferred FHC conditions optimized to the ring-opening of aromatic hydrocarbons include a temperature of 300-400° C., a pressure of 600-3000 kPa gauge and a Weight Hourly Space Velocity of 0.2-2 h-1.

As used herein, the term "dearomatization unit" relates to a refinery unit for the separation of aromatic hydrocarbons, such as BTX, from a mixed hydrocarbon feed. Such dearomatization processes are described in Folkins (2000) Benzene, Ullmann's Encyclopedia of Industrial Chemistry. Accordingly, processes exist to separate a mixed hydrocarbon stream into a first stream that is enriched for aromatics and a second stream that is enriched for paraffins and naphthenes. A preferred method to separate aromatic hydrocarbons from a mixture of aromatic and aliphatic hydrocarbons is solvent extraction; see e.g. WO 2012135111 A2. The preferred solvents used in aromatic solvent extraction are sulfolane, tetraethylene glycol and N-methylpyrolidone which are commonly used solvents in commercial aromatics extraction processes. These species are often used in combination with other solvents or other chemicals (sometimes called co-solvents) such as water and/or alcohols. Non-nitrogen containing solvents such as sulfolane are particularly preferred. Commercially applied dearomatization processes are less preferred for the dearomatization of hydrocarbon mixtures having a boiling point range that exceeds 250° C., preferably 200° C., as the boiling point of the solvent used in such solvent extraction needs to be lower than the boiling point of the aromatic compounds to be extracted. Solvent extraction of heavy aromatics is described in the art; see e.g. U.S. Pat. No. 5,880,325. Alternatively, other known methods than solvent extraction, such as molecular sieve separation or separation based on boiling point, can be applied for the separation of heavy aromatics in a dearomatization process.

A process to separate a mixed hydrocarbon stream into a stream comprising predominantly paraffins and a second stream comprising predominantly aromatics and naphthenes comprises processing said mixed hydrocarbon stream in a solvent extraction unit comprising three main hydrocarbon processing columns: solvent extraction column, stripper column and extract column. Conventional solvents selective for the extraction of aromatics are also selective for dissolving light naphthenic and to a lesser extent light paraffinic species hence the stream exiting the base of the solvent extraction column comprises solvent together with dissolved aromatic, naphthenic and light paraffinic species. The stream exiting the top of the solvent extraction column (often termed the raffinate stream) comprises the relatively insoluble, with respect to the chosen solvent) paraffinic species. The stream exiting the base of the solvent extraction column is then subjected, in a distillation column, to evaporative stripping in which species are separated on the basis of their relative volatility in the presence of the solvent. In the presence of a solvent, light paraffinic species have higher relative volatilities than naphthenic species and especially aromatic species with the same number of carbon atoms, hence the majority of light paraffinic species may be concentrated in the overhead stream from the evaporative stripping column. This stream may be combined with the raffinate stream from the solvent extraction column or collected as a separate light hydrocarbon stream. Due to their relatively low volatility the majority of the naphthenic and especially aromatic species are retained in the combined solvent and dissolved hydrocarbon stream exiting the base of this column. In the final hydrocarbon processing column of the extraction unit, the solvent is separated from the dissolved hydrocarbon species by distillation. In this step the solvent, which has a relatively high boiling point, is recovered as the base stream from the column whilst the dissolved hydrocarbons, comprising mainly aromatics and naphthenic species, are recovered as the vapor stream exiting the top of the column. This latter stream is often termed the extract.

The process of the present invention may require removal of sulfur from certain crude oil fractions to prevent catalyst deactivation in downstream refinery processes, such as catalytic reforming or fluid catalytic cracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

As used herein, the term "gas separation unit" relates to the refinery unit that separates different compounds comprised in the gases produced by the crude distillation unit and/or refinery unit-derived gases. Compounds that may be separated to separate streams in the gas separation unit comprise ethane, propane, butanes, hydrogen and fuel gas mainly comprising methane. Any conventional method suitable for the separation of said gases may be employed. Accordingly, the gases may be subjected to multiple compression stages wherein acid gases such as C02 and H2S may be removed between compression stages. In a following step, the gases produced may be partially condensed over stages of a cascade refrigeration system to about where only the hydrogen remains in the gaseous phase.

A process for the conversion of alkanes to olefins involves "steam cracking" or "pyrolysis". As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C., but the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases (C02 and H2S) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for olefins synthesis.

The term "propane dehydrogenation unit" as used herein relates to a petrochemical process unit wherein a propane feedstream is converted into a product comprising propylene and hydrogen. Accordingly, the term "butane dehydrogenation unit" relates to a process unit for converting a butane feedstream into C4 olefins. Together, processes for the dehydrogenation of lower alkanes such as propane and butanes are described as lower alkane dehydrogenation process. Processes for the dehydrogenation of lower alkanes are well-known in the art and include oxidative dehydrogenation processes and non-oxidative dehydrogenation processes. In an oxidative dehydrogenation process, the process heat is provided by partial oxidation of the lower alkane(s) in the feed. In a non-oxidative dehydrogenation process, which is preferred in the context of the present invention, the process heat for the endothermic dehydrogenation reaction is provided by external heat sources such as hot flue gases obtained by burning of fuel gas or steam. In a non-oxidative dehydrogenation process the process conditions generally comprise a temperature of 540-700° C. and an absolute pressure of 25-500 kPa. For instance, the UOP Oleflex process allows for the dehydrogenation of propane to form propylene and of (iso)butane to form (iso)butylene (or mixtures thereof) in the presence of a catalyst containing platinum supported on alumina in a moving bed reactor; see e.g. U.S. Pat. No. 4,827,072. The Uhde STAR process allows for the dehydrogenation of propane to form propylene or of butane to form butylene in the presence of a promoted platinum catalyst supported on a zinc-alumina spinel; see e.g. U.S. Pat. No. 4,926,005. The STAR process has been recently improved by applying the principle of oxydehydrogenation. In a secondary adiabatic zone in the reactor part of the hydrogen from the intermediate product is selectively converted with added oxygen to form water. This shifts the thermodynamic equilibrium to higher conversion and achieves a higher yield. Also the external heat required for the endothermic dehydrogenation reaction is partly supplied by the exothermic hydrogen conversion. The Lummus Catofin process employs a number of fixed bed reactors operating on a cyclical basis. The catalyst is activated alumina impregnated with 18-20 wt-% chromium; see e.g. EP 0 192 059 A1 and GB 2 162 082 A. The Catofin process has the advantage that it is robust and capable of handling impurities which would poison a platinum catalyst. The products produced by a butane dehydrogenation process depends on the nature of the butane feed and the butane dehydrogenation process used. Also the Catofin process allows for the dehydrogenation of butane to form butylene; see e.g. U.S. Pat. No. 7,622,623.

The present invention will be discussed in the next Example which example should not be interpreted as limiting the scope of protection.

The sole FIGURE is an embodiment of the present method of producing aromatics and light olefins from a hydrocarbon feedstock.

EXAMPLE

The process scheme can be found in the sole FIGURE. Naphtha as feedstock 11 is sent to a solvent extraction unit 2 and separated into a bottom stream 15 comprising aromatics, naphthenes, light paraffins and solvent and a raffinate 24 comprising normal and iso paraffins and solvent. To minimize solvent losses the solvent may be separated from the raffinate 24 by washing the raffinate stream 24 with water (not shown) which produces an essentially solvent free raffinate stream and a water stream containing some solvent. The latter stream may then be distilled to evaporate the water, and the raffinate stream 24 is sent to steam cracker unit 1. The solvent thus recovered can be combined with solvent rich stream 17. Stream 24 may thus be purified to recover any solvent and produce an essentially solvent free raffinate stream to be sent to steam cracker unit 1.

The bottom stream 15 is sent to a stripper column 3 and separated into a solvent stream 16 rich in aromatics and naphthenes and a stream 12 comprising stripped light paraffins. Stream 12 can be returned to solvent extraction unit 2 or can be sent as stream 22 to steam cracker unit 1. The stream 7, i.e. a combination of raffinate 24 and stream 22, comprising normal and iso paraffins, is sent to steam cracker unit 1.

Solvent stream 16 rich in aromatics and naphthenes is sent to a distillation column 4 and separated into an extract 13 comprising aromatics and naphthenes and a solvent rich stream 17, which stream 17 is returned to the solvent extraction unit 2. Extract 13 is further treated in a hydrocracking unit 5. The stream 18 thus hydrocracked is sent to a separator 6, e.g. a distillation column 6. The top stream 21 from distillation column 6 is sent as a stream 10 to the steam cracker unit 1. In addition, it is also possible to send top stream 21 to a dehydrogenation unit 25. Top stream 21 will contain a mixture of LPG species, unused hydrogen, methane and any H2S made via the hydrodesulphurization process in hydrocracking unit 5. The LPG species may be sent either to steam cracker 1 unit or to a dehydrogenation unit 25 after suitable processing to remove the hydrogen, methane and H2S. Suitable methods for carrying out this separation include cryogenic distillation. The bottom stream 14 from the distillation column 6 can be used for further processes. In the steam cracking unit 1 a pygas containing stream 23 is preferably sent to the solvent extraction unit 2. In another embodiment pygas containing stream 26 is sent to the hydrocracking unit 5.

The experimental data as provided herein were obtained by flowsheet modeling in Aspen Plus. The steam cracking kinetics were taken into account rigorously (software for steam cracker product slate calculations).

Applied steam cracker furnace conditions:

ethane and propane furnaces: COT (Coil Outlet temperature)=845° C. and steam-to-oil-ratio=0.37, C4-furnaces and liquid furnaces: Coil Outlet temperature=820° C. and Steam-to-oil-ratio=0.37. The dearomatization unit was modeled as a splitter into 2 streams, one stream containing all the aromatic and naphthenic components and the other stream containing all the normal- and iso-paraffinic components.

For the gasoline hydrocracking, a reaction scheme has been used that is based on experimental data.

As feedstock 11 naphtha was used (see Table 1)

TABLE 1

| characteristics of naphtha Naphtha | | |
|---|---|---|
| n-Paraffins | wt-% | 36.3 |
| i-Paraffins | wt-% | 27.4 |
| Naphthenes | wt-% | 24.1 |
| Aromatics | wt-% | 12.3 |
| Density 60 F. | kg/L | 0.728 |
| IBP | ° C. | 20 |
| BP50 | ° C. | 120.0 |
| FBP | ° C. | 178 |

The specific distribution of n-paraffins, 1-paraffins, naphthenes and aromatics can be found in Table 2.

TABLE 2

| C-# | N-paraffins | I-paraffins | Naphthenes | Aromatics | Sum |
|---|---|---|---|---|---|
| 5 | 6.6 | 3.1 | 0.4 | 0.0 | 10.1 |
| 6 | 7.7 | 5.9 | 2.2 | 0.5 | 16.3 j |
| 7 | 7.3 | 5.6 | 3.3 | 1.8 | 18 |
| 8 | 6.6 | 6.7 | 3.8 | 3.7 | 20.8 |
| 9 | 5.7 | 6.6 | 6.3 | 4.4 | 23 |
| 10 | 3.3 | 7.2 | 0.0 | 1.0 | 11.5 |
| Sum | 37.2 | 35.1 | 16.0 | 11.4 | |

The Example disclosed herein makes a distinction between a process (case 1) in which the naphtha is processed through a steam cracker unit and the present process (case 2) according to the sole FIGURE. Case 1 is a comparative example. Case 2 is an example according to the present invention.

The battery product slate (wt. % of feed) can be found in Table 3.

From Table 3 one can see that sending the naphthenic part of the naphtha to a hydrocracking unit causes BTX (benzene, toluene, xylenes) to increase. The present inventors assume that the hydrocracking unit converts naphthenics into aromatics.

The present inventors also found that by preventing naphthenes and aromatics to be steam-cracked, the production of heavier products (C9Resin feed, Cracked Distillate and Carbon Black Oil) is reduced from 8.5% to 2.6%.

Moreover, the methane production decreases, probably because the naphthenics are not being steam cracked but sent to the hydrocracking unit.

In addition, the overall high value chemicals content increases from 75.3% to 80.5%.

On the basis of the comparison between case 1 (comparative example) and case 2 (example according to the present invention) one can conclude that according to the present method the yield of high value products from typical naphtha can be maximized by preventing naphthenes and aromatics from generating heavier products in the steam cracker.

TABLE 3

| Feed: naphtha BATTERY LIMIT PRODUCT SLATE | CASE 1 SC | CASE 2 DEARO + SC + GHC |
|---|---|---|
| H2 | 0.8 | 1.3 |
| CH4 | 15.3 | 13.2 |
| ETHYLENE | 33.6 | 32.8 |
| PROPYLENE | 17.3 | 14.9 |
| BUTADIENE | 5.1 | 4.1 |
| 1-BUTENE | 1.8 | 1.6 |
| ISO-BUTENE | 2.1 | 1.7 |
| BENZENE | 7.2 | 8.9 |
| TX CUT | 5.8 | 18.7 |
| STYRENE | 1.2 | 0.0 |
| OTHER C7-C8 | 1.3 | 0.0 |
| C9 RESIN FEED | 2.2 | 0.4 |
| CD | 1.9 | 1.0 |
| CBO | 4.4 | 1.2 |
| % HIGH VALUE CHEMICALS | 75.3 | 80.5 |

What is claimed is:

1. A method of producing aromatics and light olefins from a hydrocarbon feedstock, the method comprising the steps of:

(a) subjecting the hydrocarbon feedstock to a solvent extraction process in a solvent extraction unit;

(b) separating from the solvent extracted hydrocarbon feedstock obtained in step (a) a raffinate fraction comprising paraffins and a fraction comprising aromatics and naphthenes;

(c) hydrocracking said fraction comprising aromatics and naphthenes in a hydrocracking unit and separating reaction products from the hydrocracking into a high content aromatics fraction and a stream high in light paraffins, wherein said hydrocracking unit is a selective hydrocracking and hydro-desulphurization unit suitable for preserving aromatic species whilst simultaneously dehydrogenating a portion of naphthenic species into aromatic species, hydrocracking non-aromatic species, including remaining naphthenic species and paraffinic species, into LPG species and hydro-desulphurising any organo-sulphur species present with the non-aromatic species, wherein the operating conditions are WHSV between 0.5 and 3 $hr^{-1}$, a $H_2$:hydrocarbon ratio between 2:1 and 4:1, pressure between 689475 Pa and 2757902 Pa and reactor inlet temperature between 470 and 550° C.;

(d) converting said raffinate fraction in a steam cracking unit into light olefins.

2. The method according to claim 1, wherein, before carrying out step (c), the fraction comprising aromatics and naphthenes is further fractionated by a stripping process to increase content of aromatics and naphthenes, wherein said stripping process is based on differences in relative volatility in the presence of said solvent.

3. The method according to claim 1, wherein, before carrying out step (c), the fraction comprising aromatics and naphthenes is further fractionated by recovering the solvent from the solvent extraction process.

4. The method according to claim 2, wherein the materials stripped from the fraction comprising aromatics and naphthenes are returned to the solvent extraction process of step (a).

5. The method according to claim 2, wherein the materials stripped from the fraction comprising aromatics and naphthenes are sent to steam cracking unit of step (d).

6. The method according to claim 1, further comprising recovering a pygas containing byproduct from the steam cracking unit and returning said recovered pygas containing byproduct to said solvent extraction process.

7. The method according to claim 1, further comprising recovering a pygas containing byproduct from the steam cracking unit and feeding said pygas containing byproduct to said hydrocracking unit.

8. The method according to claim 6, further comprising feeding said recovered solvent to the solvent extraction process at a position above inlet points of both recovered pygas containing byproduct and the hydrocarbon feedstock in said solvent extraction unit.

9. The method according to of claim 6, further comprising feeding said hydrocarbon feedstock to the solvent extraction process at a position above an inlet point of recovered pygas containing byproduct in said solvent extraction unit.

10. The method according to claim 1, further comprising recovering an LPG fraction from said hydrocracked high content aromatics fraction and returning said LPG fraction to the steam cracking unit.

11. The method according to claim 1, further comprising recovering the solvent from the raffinate fraction comprising paraffins and returning said solvent recovered into the solvent extraction process.

12. The method according to claim 1, wherein the hydrocarbon feedstock is a member selected from the group consisting of a whole range naphtha having a boiling point lower than 200° C. and kerosene.

13. The method according to claim 12, wherein the hydrocarbon feedstock is the group of whole range naphtha having a boiling point lower than 200° C.

14. The method according to claim 1, wherein, before carrying out step (c), the fraction comprising aromatics and naphthenes is further fractionated by a stripping process to increase a content of aromatics and naphthenes, said stripping process resulting in a solvent stream rich in aromatics and naphthenes and a stream comprising stripped light paraffins, in which said stripping process is based on differences in relative volatility in the presence of said solvent.

15. The method according to claim 14, wherein, before carrying out step (c), the solvent stream rich in aromatics and naphthenes is further fractionated by recovering the solvent resulting in a solvent rich stream and an extract comprising aromatics and naphthenes, and returning said solvent rich stream to said solvent extraction process of step (a), in which said fractionation is based on differences in boiling points.

16. The method according to claim 14, wherein the stream comprising stripped light paraffins is returned to the solvent extraction process of step (a).

17. The method according to claim 1, wherein there is no hydrodesulphurization ahead of the extraction process.

18. A method of producing aromatics and light olefins from a hydrocarbon feedstock, the method comprising the steps of:

(a) subjecting the hydrocarbon feedstock to a solvent extraction process in a solvent extraction unit;

(b) separating from the solvent extracted hydrocarbon feedstock obtained in step (a) a raffinate fraction comprising paraffins and a fraction comprising aromatics and naphthenes;

(c) hydrocracking said fraction comprising aromatics and naphthenes in a hydrocracking unit and separating the reaction products into a high content aromatics fraction and a stream high in light paraffins, wherein said hydrocracking unit is a selective hydrocracking and hydro-desulphurization unit suitable for preserving aromatic species whilst simultaneously dehydrogenating a portion of naphthenic species into aromatic species, hydrocracking non-aromatic species, including remaining naphthenic species and paraffinic species, into LPG species and hydro-desulphurising any organo-sulphur species present with the non-aromatic species, wherein the operating conditions are WHSV between 0.5 and 3 $hr^{-1}$, a $H_2$:hydrocarbon ratio between 2:1 and 4:1, pressure between 689475 Pa and 2757902 Pa and reactor inlet temperature of 550° C.;

(d) converting said raffinate fraction in a steam cracking unit into light olefins.

* * * * *